US009297128B1

(12) United States Patent
Tang et al.

(10) Patent No.: US 9,297,128 B1
(45) Date of Patent: Mar. 29, 2016

(54) SPIKE STRIP

(71) Applicants: Xue Bing Tang, Beijing (CN); Quan Yong Tang, Beijing (CN); Pin Yin, Beijing (CN)

(72) Inventors: Xue Bing Tang, Beijing (CN); Quan Yong Tang, Beijing (CN); Pin Yin, Beijing (CN)

( * ) Notice: Subject to any disclaimer, the term of this patent is extended or adjusted under 35 U.S.C. 154(b) by 0 days.

(21) Appl. No.: 14/530,345

(22) Filed: Oct. 31, 2014

(51) Int. Cl.
*E01F 13/12* (2006.01)

(52) U.S. Cl.
CPC ..... *E01F 13/12* (2013.01)

(58) Field of Classification Search
CPC ..... E01F 13/12
USPC ..... 404/6
See application file for complete search history.

(56) References Cited

U.S. PATENT DOCUMENTS 1,721,978 A * 7/1929 Sherwood ..... 256/1
5,253,950 A * 10/1993 Kilgrow et al. ..... 404/6
6,048,128 A * 4/2000 Jones et al. ..... 404/6
6,312,189 B1 * 11/2001 Marphetia ..... E01F 13/12 404/6
6,527,475 B1 * 3/2003 Lowrie ..... E01F 13/12 180/287
6,623,205 B1 * 9/2003 Ramirez ..... 404/6
7,850,392 B2 * 12/2010 Schubert ..... 404/6
8,231,303 B1 * 7/2012 Bowen et al. ..... E01F 13/12 404/6
8,506,203 B2 * 8/2013 Spencer et al. ..... 404/6
2006/0083587 A1 * 4/2006 Marphetia ..... 404/6
2009/0263191 A1 * 10/2009 Moormeier et al. .... E01F 13/12 404/6
2010/0284739 A1 * 11/2010 Allsopp et al. ..... 404/6

* cited by examiner

*Primary Examiner* — Thomas B Will
*Assistant Examiner* — Katherine Chu
(74) *Attorney, Agent, or Firm* — Donn K. Harms

(57) ABSTRACT

A spike strip for disabling vehicle tires is disclosed which is formed from a scissor arm assembly of a plurality of arms engaged at pivots. Moveably from a collapsed position to an elongated position the assembly has a plurality of spikes engaged thereon for puncturing vehicle tires. The spikes can be removed and replaced and can be formed into spike nets by an engaged cable.

19 Claims, 4 Drawing Sheets

SPIKE STRIP

FIELD OF THE INVENTION

The present invention relates generally to the disablement of vehicles which refuse to stop for law enforcement. More particularly the invention relates to a spike strip device and method and apparatus which employs an expanding member formed of a plurality of engaged scissor units to automatically and safely position spikes in a roadway in front of an oncoming vehicle.

PRIOR ART

In the era of twenty-four hour news, and internet communication of video, motor vehicle chases which were formerly a rare occurrence, have become an ever more frequent problem for law enforcement. It has been conjectured that some drivers actually initiate a high speed or elongated chase of their vehicle by police, so that they can see the chase they caused on the television or internet news.

However, as can be seen in a viewing of such a chase involving law enforcement officers in pursuit of criminals, or just citizens who refuse to stop, there is an ever present and serious threat to the lives of the officers, the party being pursued, and especially bystanders who may be unintentionally in the path of the chase, and unaware of the oncoming danger.

For the safety of all concerned, it is in the interest of law enforcement, to cease such chases of criminals and citizens who refuse to stop, through a disabling of the vehicle being pursued by law enforcement. Such should be done as quickly and safely as possible.

A very common mode of disabling a vehicle in chase situations noted above, is to cause the tires of the vehicle being chased, to deflate. A well known method employed to cause such a wheel and tire disablement, and thus a vehicle disablement, is through the employment of what is known as a spike strips. Conventionally, such strips use spikes or other sharp members adapted to puncture inflated rubber tires. The spikes are engaged to elongated chains or cables which are positioned in the road in locations in front of a pursued vehicle in the hopes the vehicle will run across the spike strip and one of the hooks or spikes will puncture one or more tires on the pursued vehicle.

When the pursued vehicle does run over such a spike strip, it can be effective in deflating one or more tires, and cause the vehicle to slow and eventually stop. Often however, a fleeing vehicle is aware that such a spike strip may be encountered as it is a common practices. Further, the fleeing driver anticipating such a deployment will frequently try to avoid the deployed spike strip.

Because of the need to deploy the spike strip in front of the fleeing driver, and because the deploying law officer must position the spike strip at the last moment in order to prevent the fleeing driver from avoiding contact with the deployed stip, it is a very dangerous endeavor for law officers to deploy conventional cabled or chained strips. During deployment the officer must remove the cabled device from storage, render it ready to be thrown to an elongated positioning in the roadway, and actually throw the device in front of the fleeing driver and vehicle at the very last moment. An early deployment will allow the driver to see and avoid the spike strip.

As such, conventional cabled or chain-engaged spike strips are a very dangerous endeavor to deploy for law enforcement. The deploying officer can be run over by the fleeing driver attempting to avoid the deployed spike strip. Additionally, most law enforcement officers are not adept at actually throwing a bulky, cabled spike strip from a rolled or folded position, to cause a successful unfolding and total elongating of the spike strip in the roadway. Consequently, many times when thrown in haste at the last moment to surprise the fleeing driver, the spike strip fails to elongate and properly deploy, and misses the proper positioning to disable the fleeing vehicle.

Finally, when the fleeing driver does run over conventional spike strips, they are usually destroyed or rendered useless for future attempts. This is because being cabled or chain based, they tend to wind around tires and wheels and axles and the force of such an engagement is generally sufficient to tear the spike strip apart. If the spikes successfully disable the wheel it may be worth a destroyed strip, however, because of the unpredictable deployment of such strips due to their cabled or chain or flexible make up, many times the spikes miss their mark and the spike strip is destroyed when wrapped around the moving tire and ripped apart.

As such, there is a continuing unmet need for a spike strip which will solve the noted shortcomings of conventionally deployed spike strip devices. Such a spike strip device and method should allow for a remote controlled release of a spike strip by an officer in front of an approaching vehicle at the last possible moment, but from a safe distance so as to protect officer safety and also not to allow the driver to see the officer on the side of the road and be forewarned.

Further, such a device should be configured to always fully deploy to a fully elongated position without any practice by the officer activating it from a remote position. Still further, such a device when actually deployed, should position spikes in vertical positions across the roadway where they will be more likely to spear the tires of a fleeing car.

Still further, instead of having a body configuration holding the spikes which wraps around tires and destroys the spike strip, such a device should position the plurality of spikes in a removable engagement to the elongated member holding them so that the spikes are released from the body forming the positioning member for the spikes, and thus avoid destruction of the spike strip itself. Finally, such a spike strip device, when remotely deployed from a safe position, and once it has speared the tires of a fleeing vehicle with spikes, should be easily un-deployed and should be easily rendered fit for a subsequent use by easy replacement of the spikes which have been speared into the vehicle tires.

The forgoing examples of related art and limitations related therewith are intended to be illustrative and not exclusive, and they do not imply any limitations on the invention and method described and claimed herein. Various limitations of the related art are already or will become apparent to those skilled in the art upon a reading and understanding of the specification below and the accompanying drawings.

SUMMARY OF THE INVENTION

The device and method herein disclosed and described provides a solution to the shortcomings in prior art in spike strip configuration and deployment, and achieves the above noted goals through the provision of a spike strip device formed of a member having a plurality of planar members in scissor-like engagements forming individual scissor units which make up a scissor arm assembly forming the body of the device. The total length of the deployable formed planar scissor arm assembly of the spike strip is dependant on the number of scissor units from which it is composed.

The disclosed spike strip device herein, uses this planar scissor arm assembly formed of a plurality of operatively engaged scissor units, of pivotally engaged arms, to provide a very small sized compacted mode of the scissor arm assembly which is a small fraction of the length of the member forming the body of the spike strip in a deployed or elongated configuration. Thus, a ten foot spike strip in the elongated configuration of the planar scissor arm assembly forming the body of the deployed spike strip herein, can have a compacted configuration of a foot or two in length.

The scissor arm assembly of pivoted arms, providing the body of the spike strip device herein, is planar on both sides of the individual scissor-engaged shorter members forming the scissor units which combine to form the elongated planar scissor arm assembly or body of the device. Thus a first side is planar and thus complimentary to the flat surface of most roadways.

The second surface of the elongated member forming the scissor arm assembly defining the body of the device in the deployed or the compacted position, is also planar. Thus the second surface offers a planar pathway for the tires of a fleeing vehicle to pass over, and is highly unlikely to become engaged with a wheel or axle in the manner plaguing conventional spike strips.

On this planar second surface which is parallel to the roadway surface, are positioned a plurality of spikes, in a perpendicular disposition to the planar member, and the roadway when the device is in the deployed position. Thus every spike engaged with the planar arms forming the scissor arm assembly or body, is positioned to pierce a vehicle tire instantly on contact unlike the variable and instead positioning of spikes on conventional spike strips.

Each such spike a first end removably engaged with the planar scissor arm assembly forming the body of the spike strip. The spikes are easily replaced if removed during an encounter with a vehicle tire. This removable engagement can be a direct fit into apertures formed into the shorter members forming the plurality of scissor units defining the planar scissor arm assembly of the device herein. Alternatively and preferred, the spikes can be engaged with annular fittings sided to engage with complimentary apertures formed in the shorter members defining the plurality of scissor units forming the scissor arm assembly defining the body of the device herein.

At pivot points on the engaged individual scissor unites, a biasing means urging the shorter members in a direction causing the scissor arm assembly forming the body of the device to elongate, can be engaged. Thus, the elongated body in the collapsed configuration, will automatically elongate as the individual members engaged at pivot points rotate to cause the elongation of the scissor arm assembly forming the body, and move it from the small compacted or collapsed size, to the elongated size of many feet or yards sufficient to cross one or more vehicle lanes on a roadway in front of a fleeing driver.

Using wound springs at the pivot points, or other means to bias the scissor units to an "X" like configuration of the smaller members forming it, the elongated member when collapsed to a configuration where the smaller members of the scissor units are parallel, will instantly expand back to the elongated position if not held in the collapsed position. This self-deploying biased positioning of the pivot points, allows the device herein to be easily deployed with little or no "throwing" effort by the user.

Further, the compact size of the collapsed configuration of the elongated member formed by scissor units, allows the device to be stored in a housing which is configured to hold the elongated member collapsed until deployment is desired. At that moment, the pressing of a button activating a release of the housing to deploy the elongated member, will cause an immediate elongated positioning of the elongated scissor arm assembly defining the body of the device, in a line substantially along an center axis of the elongated member in the collapsed position.

Thus an officer can place the housing holding the device in the collapsed, but biased configuration, within adjacent a roadway and move to a safe, or even hidden position. At a moment of the user's choosing, a release can then be activated, and instantaneously the generally planar scissor arm assembly forming the body of the device, will move to the elongated position, in substantially a straight line from the housing opening, and onto the roadway. This will position spikes or spears in a position held perpendicular to the roadway and in a perfect position to puncture an oncoming tire encountering a spike. It is preferable also that a means for biasing the elongated body from the housing is used during the release. This can be a spring or a an electric solenoid which will impart a pushing force to the rear of the compacted planar scissor arm assembly of pivoting arms, to thrust it from the housing to the roadway while it is expanding concurrently.

Once the device has been run over, and the fleeing vehicle moves on with deflating tires, the device can be retracted to the collapsed position back into the housing. Later on, any spikes which have been disengaged may be replaced, and the device made ready for subsequent use, with no appreciable damage to the body of the device.

In another mode of the device where biasing means such as springs are not positioned at pivot points, it can be weighted or just be fitted with very loosed pivots such that a thrusting of the device from a collapsed configuration by the spring or solenoid in the housing on release, will cause it to move to the elongated position. This can be accomplished with a weighted leading edge of the elongated member which will essentially pull the elongated member to the elongated position through inertia when the elongated member is thrust from the housing by the spring or solenoid or other biasing means on the rear of the collapsed body.

Finally, since the device self-deploys on the release of an opening of the housing holding it, it may be pre positioned in many roadways. Subsequently it may be activated by a proximate but hidden officer, or, may even be deployed by sending the release signal electronically over a wired or wireless network communication using video cameras to ascertain remotely, when to deploy the device.

With respect to the above description, before explaining at least one preferred embodiment of the herein disclosed spike strip device and method in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed spike strip device and method. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide a spike strip device which may be easily deployed remotely with no throwing effort required by the user.

It is an object of the invention to provide such a spike strip device which moves from a collapsed position to an elongated position in a manner adapted to position all spikes perpendicular to the supporting roadway, and the scissor arm assembly in a generally planar position unlikely to entangle tires or axles.

It is another object of the invention to facilitate the employment of remote control for deployment and allow the user to hide so as not to warn a fleeing driver.

It is another object of the invention provide a spike strip that is not easily destroyed during use and which may have missing spikes easily replaced and allow subsequent uses.

These and other objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the spike strip device and method herein. It is intended that the embodiments and figures disclosed herein are to be considered illustrative rather than limiting. In the drawings.

Figure 1:
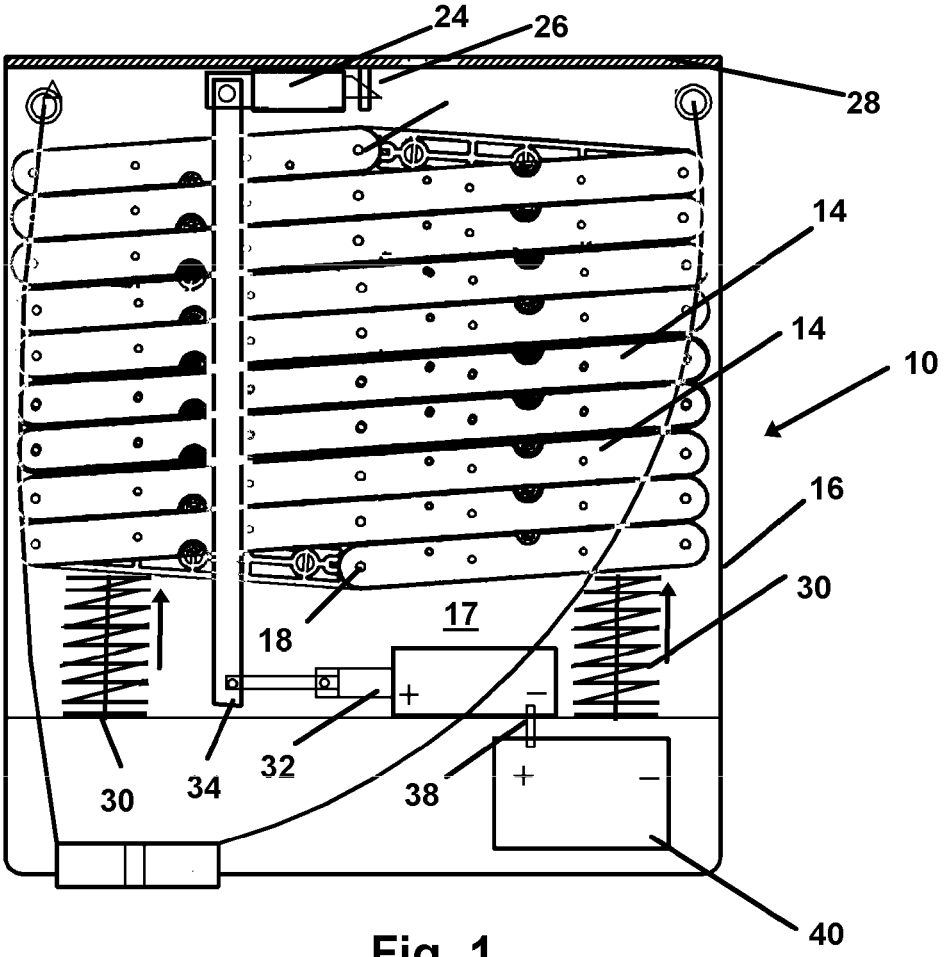
FIG. 1 shows a top view of a particularly preferred mode of the spike strip device held with the scissor arm assembly defined by the body of the device, in a collapsed mode within a remotely activated housing which would have a cover.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-9, wherein similar components are identified by like reference numerals, there is seen in FIG. 1 shows a top view of a particularly preferred mode of the spike strip device 10. As shown it is being held in a collapsed mode, with the scissor arm assembly or body 12 formed of a plurality of scissor-like sections of pivotally engaged arms 14, held within a remotely activated housing 16 which would have a cover.

Figure 6:
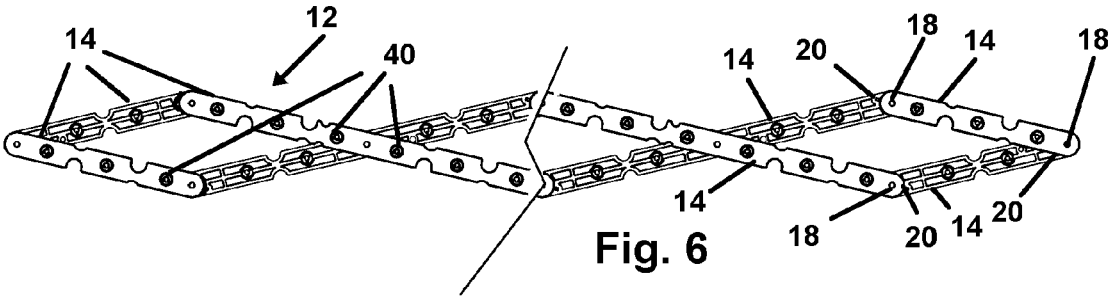
FIG. 6 shows the configuration of the body forming the scissor arm assembly, of the device in the elongated position with a total length which can vary depending on the number of pivotally engaged member sections.

Pivots 18 connect each of the arms 14 in a scissor like configuration which allow movement to form the elongated configuration of the scissor arm assembly defining the body 12 such as in FIG. 6. Means to bias the arms 14 from the collapsed position of FIG. 1, to move the scissor arm assembly or body 12 to the elongated position of FIG. 6, can be provided by any biasing component which will operatively rotate the arms 14 at a pivot 18 such as torsion springs 20 operatively engaged with the arms 14 at the point of the pivots 18. When pushed to a collapsed position of FIG. 1 the scissor arm assembly or body 12, the springs 20 store energy which is employable when the housing 16 is opened, such as in FIG. 6 discussed below, to impart an immediate rotation to the arms 14 at the points of the pivots 18 and move the body 12 or scissor arm assembly, from the collapsed position held in FIG. 1, to the elongated position where all the arms 14 are fully crossed and extended as in FIG. 6.

Additionally shown in FIG. 1 are a means to eject the scissor arm assembly or body 12 from the housing 16 interior cavity 17, upon activation of a release 24 to a latch 26 holding a door 28 of the housing 16 closed. The means for ejection of the body 12 from the cavity 17 shown are springs 30 but a solenoid 32, or a rail type electric motor, (not shown) or another remotely activatable translating component, which will exert force to a rear side of the body 12 opposite the door 28, upon an opening of the door 28, could also be used.

As noted remote control to activate an opening of the cavity 17 of the housing 16 on a roadway facing side of the housing 16 are preferable to allow the user to be remotely located for both stealth use and user safety. Shown are a solenoid 32 which activates to pull release member 34 to activate a release 24 of the latch 26 to the door 28. The solenoid 32 may be energized by a switch 38 which having direct contacts with a wired switch controller, or it may be configured to be activated by a signal, communicated from a wireless or wired network connection with the switch 38, to cause it to connect power from a power source 40 such as a battery or grid connection, to the solenoid 32. Such mechanical and wireless and network connections are well known in the art, and need not be shown. Alternatively, the switch 38 can operate with bluetooth or Wifi or on a cellular band, and be activated from a short distance, using a smartphone in direct communication with the switch 38, or using a cellular, Wifi, or other wireless signal from a wireless cellular system in a city. Such allows the user to be located a short distance from the device 10 which is situated at a roadside with the door 28 facing the roadway, and activate to it to open the door 28 and eject the body 12, with a smartphone or wireless control or push button directly wired to the device 10, which once activated will eject from the housing 16 and concurrent with the ejection, elongate to assume the elongated position in the roadway, along a substantially straight line, normal to the door 28 surface.

Figure 2:
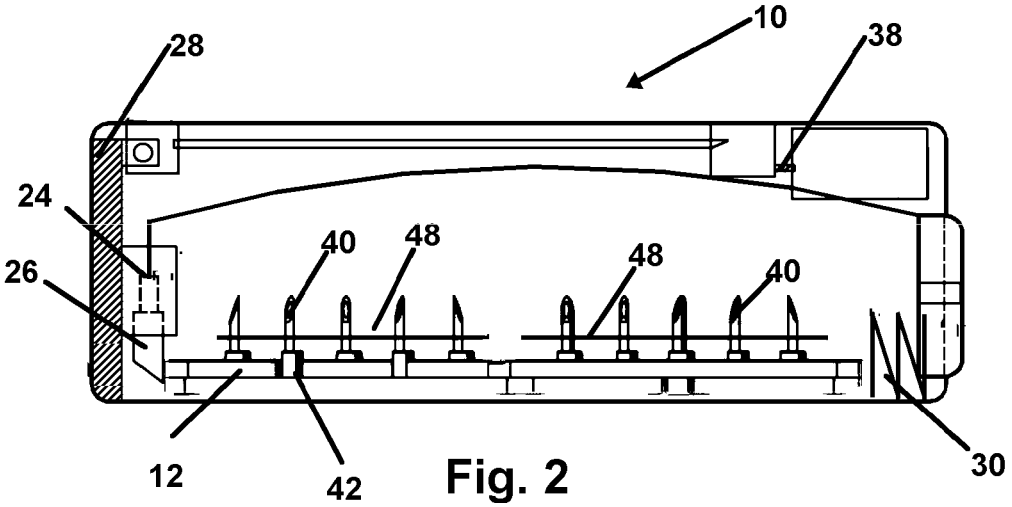
FIG. 2 shows a sectional view through FIG. 1 showing the remotely activated release of the housing and the spikes extending from releasably engaged positions on the collapsed pivotally engaged arms defining the scissor arm assembly or body.

FIG. 2 shows a sectional view through FIG. 1 showing the remotely activated release 24 of the latch 26 holding the door 28 which may be positioned against a first side of the body 12 and release it when opened as in FIG. 2. Or the release 24 can move the latch 26 out of an engagement with the first side of the collapsed scissor arm assembly defined by the body 12 shown in FIG. 2, and the body 12 ejected by the springs 30, and opening the door 28 by contact therewith in the process.

Also shown in FIG. 2 are the spikes 40 engaged with sleeves 42 which are positioned in apertures 44 in the arms 14 forming the scissor sections of scissor arm assembly or body 12. Additionally, shown is a cable 48 which engages with a plurality of spikes 40 to form spike nets, which engage the tire of a vehicle once one or more spikes 40 puncture the tire. The cable 48 engaged spikes 40 formed into nets in this fashion, keeps removed parts from the device from littering the roadway.

Figure 3:
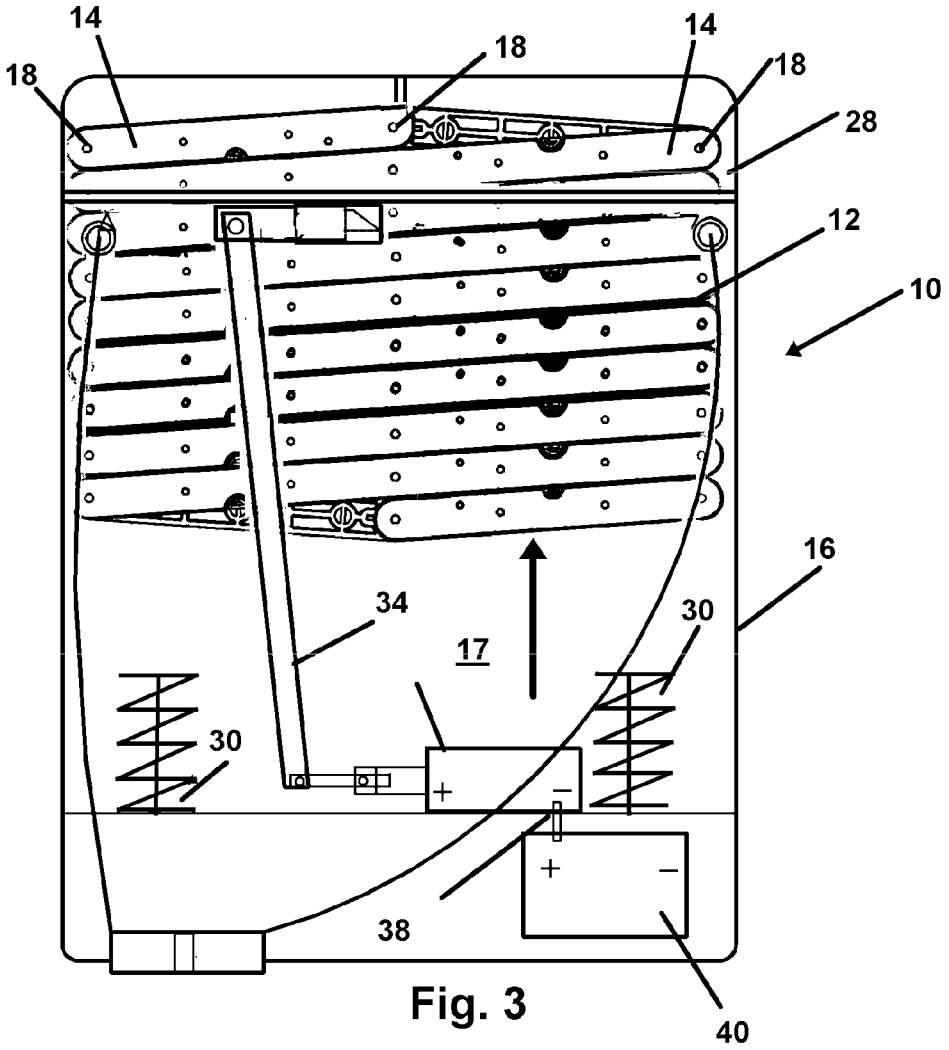
FIG. 3 shows another overhead view of the device being released from the collapsed mode of FIG. 1, and exiting the housing in a substantially straight line along which the body defining the scissor arm assembly will move to the elongated position of the assembly, of FIG. 6.

FIG. 3 shows another overhead view of the device 10 where the scissor arm assembly or body 12 is being released from the collapsed mode of FIG. 1, and exiting the housing 16 in a substantially straight line normal to the door 28 edge. Ejected by the biasing of the springs 30 the scissor arm assembly or the body 12 will immediately assume the elongated position of FIG. 6, of all arms 14 using the biasing force of the springs 20 operatively engaged at the pivots 18 of the arms 14. Thus the body 12 is ejected straight onto the roadway, and assumes the elongated position of anywhere from 12 to 30 feet in length, depending on the number of scissored-sections of pivoting arms 18 making up the scissor arm assembly or body 12.

Figure 4:
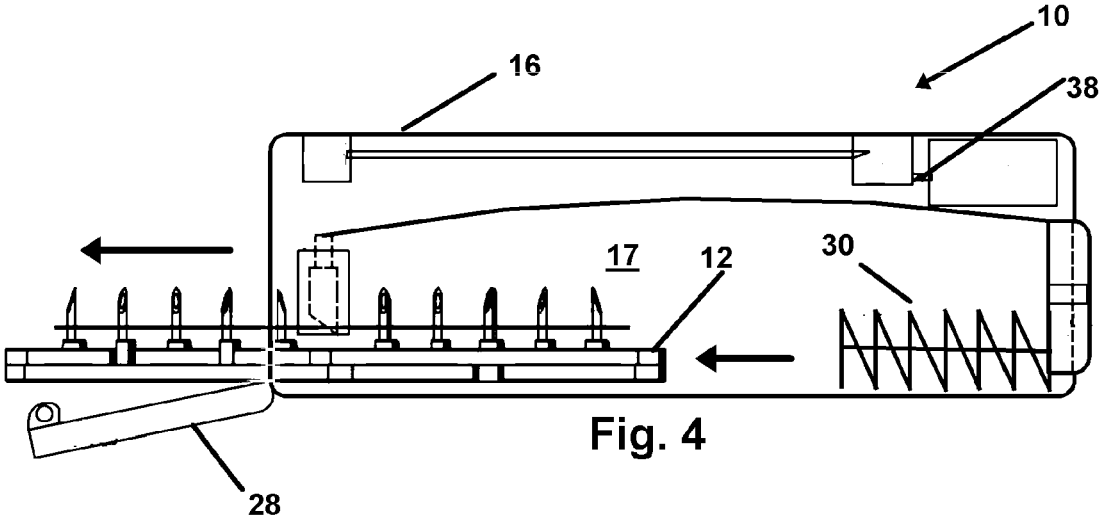
FIG. 4 shows a sectional view through FIG. 3 showing the body of the device showing spikes engaged to the arms of the scissor arm assembly formed by the body, moving from the housing to assume an elongated position on a roadway.

FIG. 4 shows a sectional view through FIG. 3 showing the body 12 forming the scissor arm assembly of the device with engaged spikes 40 forming spike nets with engaged cables 48, moving from out of the cavity 17 of the housing 16, to assume an elongated position on a roadway.

Figure 5:
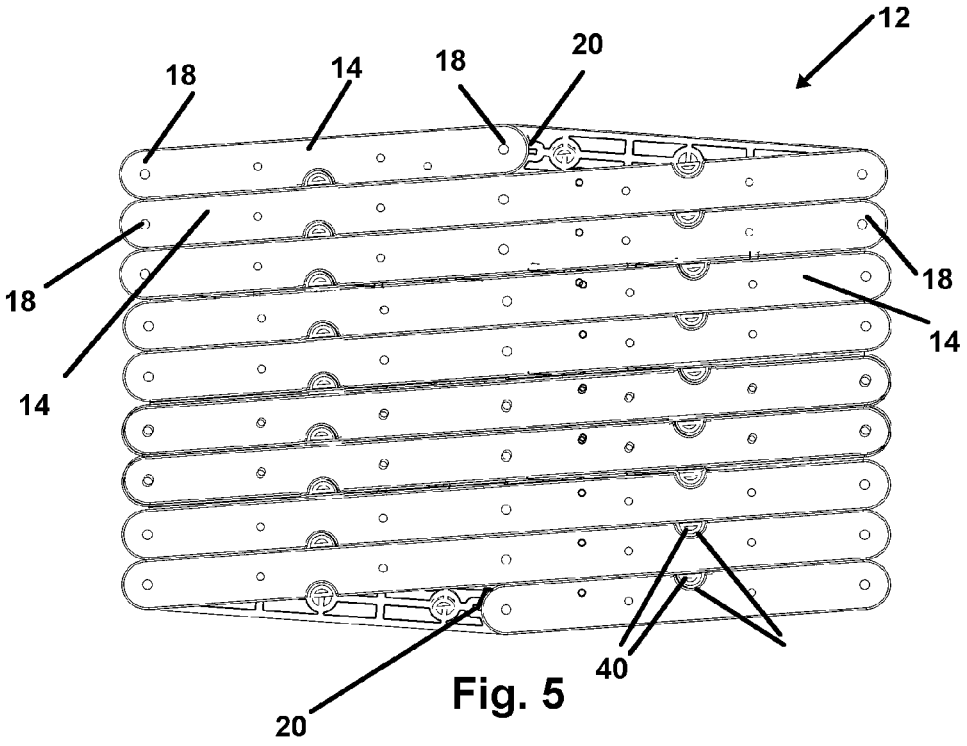
FIG. 5 shows the scissor arm assembly or body defined by the pivotally engaged arms forming of the device in the collapsed configuration formed or shorter members engaged at pivots which move to the elongated configuration of FIG. 6 concurrent with the exit from the housing.

An overhead view of the body 12 or scissor arm assembly in the collapsed configuration, is shown in FIG. 5. As depicted, the pivotally engaged arms 14, are substantially parallel and adjacent each other thus forming a collapsed size for the body 12 which has an area which is the product of multiplying the length of the longest arm 14 times the sum of the total width of all the arms 14 adjacent each other.

In this collapsed position, as noted, the torsion springs 20 engaged to the arms 14 at each pivot 18, store energy which when release, will rotate the engaged arms 14 at each pivot 18, and move the scissor arm assembly or body 12 to the elongated configuration. Such is shown in FIG. 6 which shows a plurality of pivotally engaged arms 14 forming scissor like sections appearing like parallelograms, moved to form the elongated configuration. Also shown in FIG. 5, are notches 43 which when formed in to the edge of the arms 14 forming the scissor arm assembly or body 12, allow for more compact folding to the compacted position since they allow the edges of the arms 14 which might otherwise impact against the edge of a spike 40 to surround it and move closer.

Figure 7:
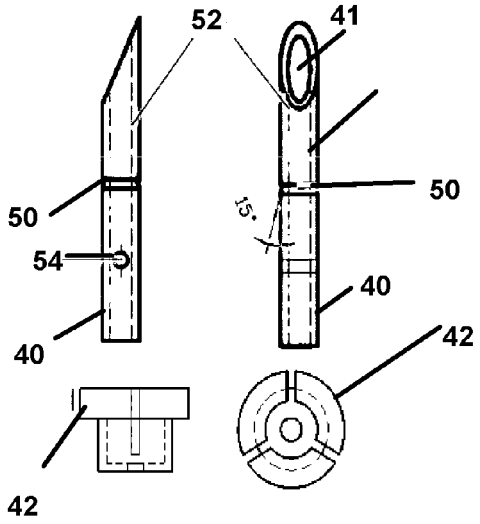
FIG. 7 shows an enlarged view of the spikes engaged with a compressive sleeve employed in the preferred mode, to mate the spikes with complimentary apertures formed in the smaller members making up the body of the device.

FIG. 7 shows an enlarged view of the spikes 40 which are to be engaged with a compressive sleeve 42. The sleeve 42 is sized to engage in an aperture 44 formed in a respective arm 14 which is of a diameter to cause the sleeve 42 to compress around the circumference of the spike 40 and hold it in a removable engagement to the body 12. An angled edge 52 forms a knife at the distal end of the spike 40 to pierce a tire. Also, a recess 50 forms a barb on the end of the spike, which the tire will engage to hold the distal end of the spike in engagement with the interior of the tire and allow the air to escape through an axial passage 41 of the spike 40.

Figure 8:
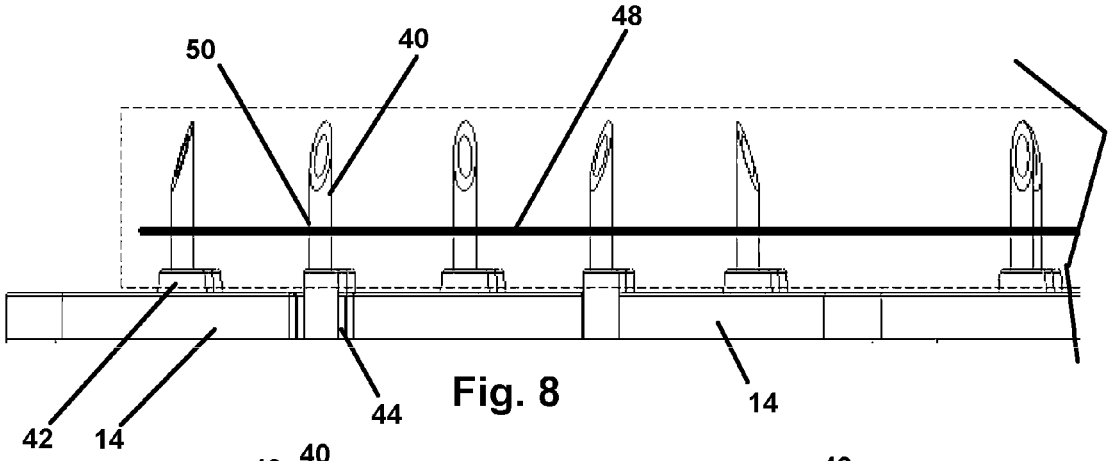
FIG. 8 depicts the spikes and sleeves of FIG. 7, engaged into the smaller scissor-like or pivotally engaged members forming the body where the apertures compress the sleeve slightly to form a removable engagement with the spikes.

FIG. 8 depicts the spikes 40 and sleeves 42 of FIG. 7, engaged into the smaller scissor-like or pivotally engaged arms 14 forming the scissor arm assembly or body 12 with the apertures 44 compressing the sleeve 42 slightly to form a removable engagement with the spikes 40. Also shown is the cable 48 which can be engaged through apertures 54 in a plurality of spikes 40, to form spike nets which will cause all the spikes 40 in a net, to engage with multiple points on a tire, once a first spike 40 punctures the tire, and keeps parts from littering the road. However, the device may also be employed without the cable 48 and allow individual spikes 40 to engage tires, and will still provide a significant improvement in the art.

Figure 9:
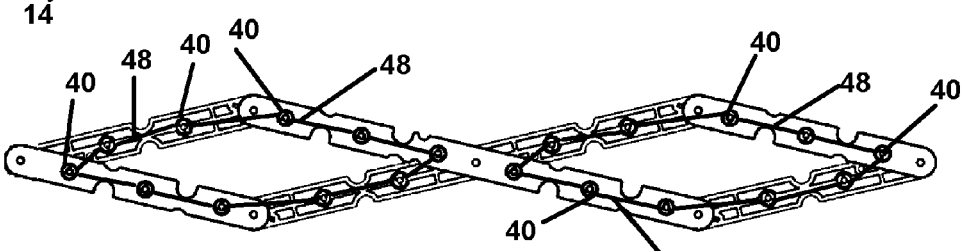
FIG. 9 depicts a pair of pivotally engaged scissor-like sections, formed of pivoting arms of the assembly moved to the elongated configuration, with the spikes engaged and formed into nets of spikes, by an engaged cable, on each four sided section.

FIG. 9 depicts a pair of pivotally engaged scissor-like sections formed of pivoting arms 14, in the elongated configuration of the scissor arm assembly or body 14, with the spikes 40 formed into nets of spikes by an engaged cable 48 running through the apertures 54 of a plurality of spikes 40 in each angled section.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the spike strip invention and method of employment have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A spike strip apparatus, comprising:

a scissor arm assembly formed of a plurality of arms engaged at pivots;

said scissor arm assembly having a collapsed position and having an elongated position;

a plurality of spikes each having an axial conduit therethrough and mounted to said arms at a respective first end, and extending to a distal end comprising an angled edge configured for tire air to enter and then to exit from the first end of the axial conduit;

a housing having an interior cavity accessed by a door;

said scissor arm assembly in said collapsed position positionable within said interior cavity, whereby it is maintained disengaged from said housing but in said collapsed position while therein;

automated means for ejecting said disengaged scissor arm assembly from said housing upon an activation of a release;

said scissor arm assembly assuming said elongated position when ejected from said housing, whereby said spike strip is storable in said collapsed position within said housing, and releasable to eject to an as-used position, disconnected from said housing in position a distance therefrom elongated upon a roadway surface with said spikes extending from said arms in a vertical positioning relative to said roadway, upon said activation of said release by a user.

2. The spike strip apparatus of claim 1, additionally comprising:

said activation of said release, being an activation component responsive to a remote control that is remotely positionable from said housing, thereby allowing said user to be positioned a distance from said roadway, and employ said activation component to automatedly move said spike strip to said as-used position.

3. The spike strip apparatus of claim 1, additionally comprising:

biasing components engaged with said arms at said pivots, said biasing components imparting a rotational force to said arms engaged at a said pivot in opposing directions, with said scissor arm assembly in said collapsed position, to thereby force said scissor arm assembly toward said elongated position.

4. The spike strip apparatus of claim 2, additionally comprising:

biasing components engaged with said arms at said pivots, said biasing components imparting a rotational force to said arms when said scissor arm assembly is in said collapsed position force said scissor arm assembly to said elongated position.

5. The spike strip apparatus of claim 3, wherein said biasing component is a torsion spring.

6. The spike strip apparatus of claim 4, wherein said biasing component is a torsion spring.

7. The spike strip apparatus of claim 1 additionally comprising:

said plurality of spikes being in respective removable engagements with apertures in said arms.

8. The spike strip apparatus of claim 2 additionally comprising:

said plurality of spikes being in respective removable engagements with apertures in said arms.

9. The spike strip apparatus of claim 4 additionally comprising:

said plurality of spikes being in respective removable engagements with apertures in said arms.

10. The spike strip apparatus of claim 6 additionally comprising:

said plurality of spikes being in respective removable engagements with apertures in said arms.

11. The spike strip apparatus of claim 1 additionally comprising:

each of said plurality of spikes having a groove formed around a circumference of said spikes adjacent said distal end; and said groove forming a barb to maintain a piercing contact of said spike within a tire.

12. The spike strip apparatus of claim 2 additionally comprising:

each of said plurality of spikes having a groove formed around a circumference of said spikes adjacent said distal end; and said groove forming a barb to maintain a piercing contact of said spike within a tire.

13. The spike strip apparatus of claim 3 additionally comprising:

each of said plurality of spikes having a groove formed around a circumference of said spikes adjacent said distal end; and said groove forming a barb to maintain a piercing contact of said spike within a tire.

14. The spike strip apparatus of claim 4 additionally comprising:

each of said plurality of spikes having a groove formed around a circumference of said spikes adjacent said distal end; and said groove forming a barb to maintain a piercing contact of said spike within a tire.

15. The spike strip apparatus of claim 6 additionally comprising:

each of said plurality of spikes having a groove formed around a circumference of said spikes adjacent said distal end; and said groove forming a barb to maintain a piercing contact of said spike within a tire.

16. The spike strip apparatus of claim 7 additionally comprising:

each of said plurality of spikes having an aperture communicating therethrough;

a cable engaged through each said aperture of each of a number of each of said plurality of spikes;

said cable forming a spike net wherein all said spikes engaged therewith, dismount concurrently as a group from said arms, upon a piercing of one of said spikes of said group, of a vehicle engaged tire traversing said spike strip.

17. The spike strip apparatus of claim 10 additionally comprising:

each of said plurality of spikes having an aperture communicating therethrough;

a cable engaged through each said aperture of each of a number of each of said plurality of spikes;

said cable forming a spike net wherein all said spikes engaged therewith, dismount concurrently as a group from said arms, upon a piercing of one of said spikes of said group, of a vehicle engaged tire traversing said spike strip.

18. The spike strip apparatus of claim 11 additionally comprising:

each of said plurality of spikes having an aperture communicating therethrough;

a cable engaged through each said aperture of each of a number of each of said plurality of spikes;

said cable forming a spike net wherein all said spikes engaged therewith, dismount concurrently as a group from said arms, upon a piercing of one of said spikes of said group, of a vehicle engaged tire traversing said spike strip.

19. The spike strip apparatus of claim 15 additionally comprising:

each of said plurality of spikes having an aperture communicating therethrough;

a cable engaged through each said aperture of each of a number of each of said plurality of spikes;

said cable forming a spike net wherein all said spikes engaged therewith, dismount concurrently as a group from said arms, upon a piercing of one of said spikes of said group, of a vehicle engaged tire traversing said spike strip.

* * * * *